US009605885B2

(12) United States Patent
Hatanaka et al.

(10) Patent No.: US 9,605,885 B2
(45) Date of Patent: Mar. 28, 2017

(54) AIR CONDITIONING SYSTEM INCLUDING PRESSURE CONTROL DEVICE AND BYPASS VALVE

(71) Applicants: Kensaku Hatanaka, Tokyo (JP); Kazuyoshi Shinozaki, Cypress, CA (US); Joseph Paul Bush, Cypress, CA (US); Peter Christian Flynn, Cypress, CA (US)

(72) Inventors: Kensaku Hatanaka, Tokyo (JP); Kazuyoshi Shinozaki, Cypress, CA (US); Joseph Paul Bush, Cypress, CA (US); Peter Christian Flynn, Cypress, CA (US)

(73) Assignee: Mitsubishi Electric Corporation, Tokyo (JP)

( * ) Notice: Subject to any disclaimer, the term of this patent is extended or adjusted under 35 U.S.C. 154(b) by 726 days.

(21) Appl. No.: 13/826,552

(22) Filed: Mar. 14, 2013

(65) Prior Publication Data

US 2014/0260386 A1 Sep. 18, 2014

(51) Int. Cl.

| | |
|---|---|
| ***F25B 41/00*** | (2006.01) |
| ***F25B 49/02*** | (2006.01) |
| ***F25B 13/00*** | (2006.01) |

(52) U.S. Cl.

CPC ..... *F25B 49/02* (2013.01); *F25B 13/00* (2013.01); *F25B 2313/0231* (2013.01);

(Continued)

(58) Field of Classification Search

CPC F25B 46/02; F25B 13/00; F25B 2313/02741; F25B 2600/2501; F25B 49/02

See application file for complete search history.

(56) References Cited

U.S. PATENT DOCUMENTS 5,937,658 A * 8/1999 Black ..... F25B 49/027 62/196.1
6,148,632 A * 11/2000 Kishita ..... B60H 1/00914 62/196.4

(Continued)

FOREIGN PATENT DOCUMENTS

EP 1489367 A1 12/2004
JP 02-106668 A 4/1990

(Continued)

OTHER PUBLICATIONS

Atsushi, Air Conditioner, Jan. 8, 2003, JP2003004335A, Whole Document.*

(Continued)

*Primary Examiner* — Larry Furdge
(74) *Attorney, Agent, or Firm* — Posz Law Group, PLC

(57) ABSTRACT

An air conditioning system includes: first and second utilization side heat exchangers and a heat source side heat exchanger respectively connected in series; a compressor connected between the first utilization side heat exchanger and the heat source side heat exchanger; an expansion valve connected between the first utilization side heat exchanger and the second utilization side heat exchanger; a pressure control device connected between the second utilization side heat exchanger and the heat source side heat exchanger; and a bypass valve connected between the expansion valve and the heat source side heat exchanger. The bypass valve provides a variable amount of liquid refrigerant flowing from the expansion valve to the heat source side heat exchanger. The pressure control device and the bypass valve cooperate with each other to keep a temperature of the compressor below a maximum allowable temperature predetermined for the compressor.

17 Claims, 6 Drawing Sheets

(52) U.S. Cl.
CPC ..... *F25B 2313/0234* (2013.01); *F25B 2313/02321* (2013.01); *F25B 2313/02322* (2013.01); *F25B 2313/02741* (2013.01); *F25B 2313/0314* (2013.01); *F25B 2313/0315* (2013.01); *F25B 2341/0662* (2013.01); *F25B 2600/2501* (2013.01)

(56) References Cited

U.S. PATENT DOCUMENTS

| | | | | |
|---|---|---|---|---|
| 6,701,729 | B2 * | 3/2004 | Bagley | F25B 41/04 62/156 |
| 2008/0168781 | A1 * | 7/2008 | Yakumaru | F25B 9/008 62/87 |

FOREIGN PATENT DOCUMENTS

| | | | | |
|---|---|---|---|---|
| JP | H02242058 | A | * | 9/1990 |
| JP | 03-125868 | A | | 5/1991 |
| JP | 04-006373 | A | | 1/1992 |
| JP | 04-359767 | A | | 12/1992 |
| JP | 05-231749 | A | | 9/1993 |
| JP | 05-322351 | A | | 12/1993 |
| JP | 2000283574 | A | * | 10/2000 |
| JP | 2003004335 | A | * | 1/2003 |
| JP | 2004361019 | A | * | 12/2004 |
| JP | EP1519123 | A2 | * | 3/2005 |
| JP | WO2008004621 | A1 | * | 1/2008 |
| JP | 2009-222357 | A | | 10/2009 |
| WO | 2004/040208 | A1 | | 5/2004 |
| WO | 2008/117408 | A1 | | 2/2008 |
| WO | 2009/133640 | A1 | | 11/2009 |
| WO | 2010/061643 | A1 | | 6/2010 |
| WO | 2010/109571 | A1 | | 9/2010 |
| WO | 2010/128557 | A1 | | 11/2010 |
| WO | 2011/074028 | A1 | | 6/2011 |

OTHER PUBLICATIONS

Hiromune et al., Air conditioning System, Jan. 10, 2008, WO2008/004621A1, Whole Document.*

Kazuhisa et al., Air Conditioner, Dec. 24, 2004, JP2004361019A, Whole Document.*

Dotto et al., Refrigerating Device, Oct. 13, 2000, JP2000283574A, Whole Document.*

Kenji, Cooling Cycle, Mar. 30, 2005, EP1519123A2, Whole Document.*

Hiroshi et al., Air Conditioner, Sep. 26, 1990, JPH02242058A, Whole Document.*

Yoneda et al., Air Conditioner, Sep. 26, 1990, Whole Document.*

International Search Report and Written Opinion mailed Oct. 20, 2014 in the corresponding PCT application No. PCT/JP2014/001477.

Office Action dated Aug. 11, 2016 issued in corresponding CA patent application No. 2,903,697.

* cited by examiner

AIR CONDITIONING SYSTEM INCLUDING PRESSURE CONTROL DEVICE AND BYPASS VALVE

TECHNICAL FIELD

The technical field relates in general to air conditioning systems, and more particularly to an air conditioning system equipped with a variable bypass valve that reduces the temperature of refrigerant entering a compressor during normal system operation, and that aids in quickly circulating refrigerant that would otherwise be unable to flow during a defrost system operation.

BACKGROUND

Conventional air conditioning systems provide heating and cooling to the interiors of buildings and other contained spaces via interior utilization side heat exchangers. During normal system operation, refrigerant flows through one or more utilization side heat exchangers before flowing through an exterior heat source side heat exchanger. After exiting the heat source side exchanger, the refrigerant enters a compressor, where its pressure and temperature are rapidly increased. The refrigerant then exits the compressor in liquid phase, as is known in the art.

However, the temperature of the refrigerant as it is discharged from the compressor must be below a predetermined maximum allowable temperature associated with the compressor. Specifically, if the temperature of refrigerant exiting the compressor exceeds the predetermined maximum allowable temperature, the compressor will likely fail. Conventionally, it is difficult to downwardly adjust the temperature of the refrigerant entering the heat source side heat exchanger prior to the refrigerant entering the compressor. Therefore, the refrigerant entering the compressor may result in a discharge temperature of the compressor that is above the maximum allowable temperature.

Japanese Patent Application Publication No. 2009-222357 describes an air conditioning system that is equipped with a refrigerant circuit including a compressor, condenser, an expansion mechanism, and first and second evaporators, respectively. A zeotropic refrigerant mixture circulates through the refrigerant circuit.

The refrigerant circuit also includes a pressure control device located between the first and second evaporators for reducing pressure of the refrigerant one or more times during the evaporation process as the refrigerant flows between the first and second evaporators. The decrease in pressure is ultimately helpful in decreasing the suction pressure of the refrigerant entering the compressor.

However, the refrigerant circuit does not decrease suction temperature of the refrigerant as it flows from the second evaporator to the compressor. Thus, the suction temperature of the refrigerant flowing into the compressor from the second evaporator may be above a tolerance, or in other words a predetermined maximum allowable temperature, of the compressor as the refrigerant flows from the compressor.

In addition, in the system above frost forms on the heat source side heat exchanger during system operation. When the system is operated in a defrost mode, the maximum opening degree of the pressure control device is small. As a result, very little refrigerant passes through the pressure control device to circulate through the refrigerant circuit, resulting in a shortage in system defrost capacity. If refrigerant is forced through the pressure control valve during the defrost mode, damage to the pressure control valve can occur.

There is therefore a need for a refrigerant circuit that can reduce the temperature of refrigerant flowing into a compressor from a heat exchanger to a level where the temperature of the refrigerant flowing from the compressor is within a fault tolerance of the compressor. There is also a need for a refrigerant circuit that can provide adequate condenser defrost capacity even when a pressure control device is present in the circuit.

SUMMARY

Accordingly, one embodiments described herein provides an air conditioning system comprising first and second utilization side heat exchangers, a heat source side heat exchanger, a compressor, an expansion valve, a pressure control device, and a bypass valve. The first and second utilization side heat exchangers and the heat source side heat exchanger are respectively connected in series. The compressor is connected between the first utilization side heat exchanger and the heat source side heat exchanger.

The expansion valve is connected between the first utilization side heat exchanger and the second utilization side heat exchanger. The pressure control device is connected between the second utilization side heat exchanger and the heat source side heat exchanger. The bypass valve is connected between the expansion valve and the heat source side heat exchanger.

The pressure control device is configured to maintain refrigerant that flows from the second utilization side heat exchanger to the heat source side heat exchanger at a predefined pressure. The bypass valve is configured to make refrigerant from the expansion valve bypass the second utilization side heat exchanger and the pressure control device. Lastly, the pressure control device and the bypass valve are configured in cooperation with each other to keep a temperature of the compressor below a maximum allowable temperature predetermined for the compressor.

A second embodiment described herein further provides an air conditioning system comprising first and second utilization side heat exchangers, a heat source side heat exchanger, a compressor, an expansion valve, a pressure control device, and a bypass valve. In the second embodiment, the components listed above are disposed as in the first embodiment. However in the second embodiment, during a defrost system operation the bypass valve is configured to be opened so as to make refrigerant from the heat source side heat exchanger bypass the pressure control device.

A third embodiment described herein further provides an air conditioning system comprising first and second utilization side heat exchangers, a heat source side heat exchanger, a compressor, an expansion valve, a pressure control device, and a bypass valve. In the third embodiment, the components listed above are disposed as in the first embodiment. The pressure control device is configured to maintain refrigerant that flows from the second utilization side heat exchanger to the heat source side heat exchanger at a predefined pressure. The bypass valve is configured to provide a variable amount of liquid refrigerant flowing from the expansion valve to the heat source side heat exchanger.

Another embodiment described herein provides a controller that includes a central processing unit (CPU) that is in communication with an air conditioning system. The air conditioning system includes first and second utilization side heat exchangers, a heat source side heat exchanger, a compressor, an expansion valve, a pressure control device, and a bypass valve similar to those described above in the first embodiment.

The CPU is configured to execute instructions that cause the pressure control device to, during a normal system operation, maintain refrigerant that flows from the second utilization side heat exchanger to the heat source side heat exchanger at a predefined pressure. The CPU is further configured to execute instructions that cause the bypass valve to make refrigerant from the expansion valve bypass the second utilization side heat exchanger and the pressure control device. The CPU is further configured to execute instructions that cause the pressure control device and the bypass valve to cooperate with each other to keep a temperature of the compressor below a maximum allowable temperature predetermined for the compressor.

It should be noted that the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

The accompanying figures, where like reference numerals refer to identical or functionally similar elements and which together with the detailed description below are incorporated in and form part of the specification, serve to further illustrate various exemplary embodiments and to explain various principles and advantages in accordance with the embodiments.

DETAILED DESCRIPTION

The instant disclosure is provided to further explain in an enabling fashion the best modes of performing one or more embodiments. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. It is noted that some embodiments may include a plurality of processes or steps, which can be performed in any order, unless expressly and necessarily limited to a particular order; i.e., processes or steps that are not so limited may be performed in any order.

Figure 1:
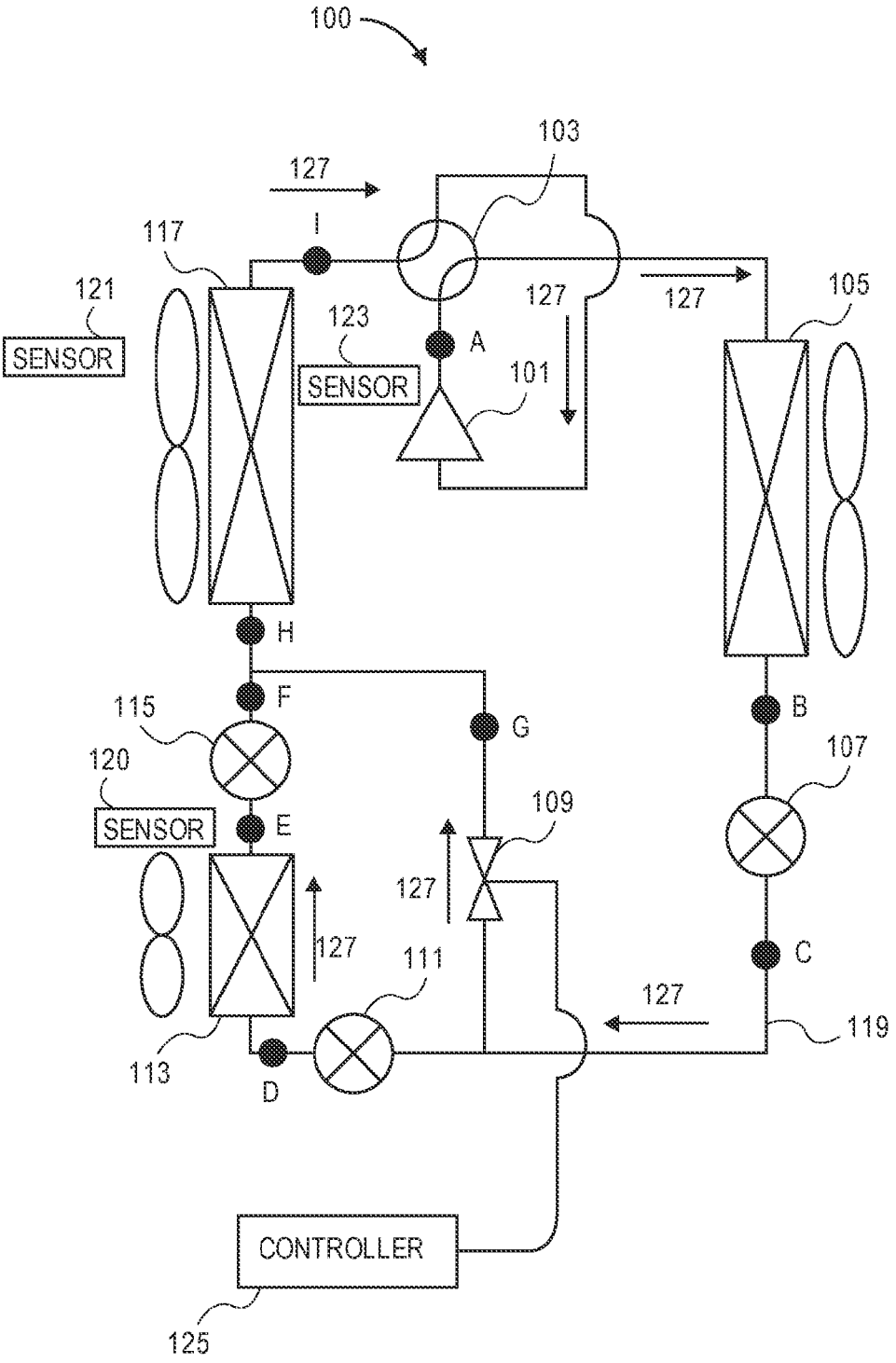
FIG. 1 is a diagram illustrating an air conditioning system with a pressure control device and bypass valve according to a first embodiment, during normal system operation.

Exemplary air conditioning systems in accord with various embodiments are now described. Referring now to FIG. 1, a diagram illustrating an air conditioning system 100 with a pressure control device and bypass valve according to a first embodiment will be discussed and described. Specifically, the air conditioning system 100 includes a compressor 101, such as a rotary, reciprocating, or scroll-type compressor or the like, a four-way valve 103, a first utilization side heat exchanger (with fan) 105, a first expansion valve 107, a second expansion valve 111, a second utilization side heat exchanger (with fan) 113, and a heat source side heat exchanger 117 (with fan) that are connected in series by refrigerant piping identified generally at 119.

As can generally be seen from FIG. 1, the compressor 101 is connected between the first utilization side heat exchanger 105 and the heat source side heat exchanger 117. The first and second expansion valves 107, 111 are connected between the first utilization side heat exchanger 105 and the second utilization side heat exchanger 113. An evaporating pressure control device 115 is disposed between the second utilization side heat exchanger 113 and the heat source side heat exchanger 117. A bypass valve 109 connects piping at an inlet of the heat source side heat exchanger 117 with piping between the first expansion valve 107 and the second expansion valve 111. The air conditioning system 100 also includes sensors 120, 121, 123 and a controller 125 with a CPU that is in communication with the components of the air conditioning system 100. The remaining discussion refers to the sensors 120, 121, 123 as "temperature sensors." However, each sensor 120, 121, 123 could alternatively be configured as a pressure sensor.

Figure 2:
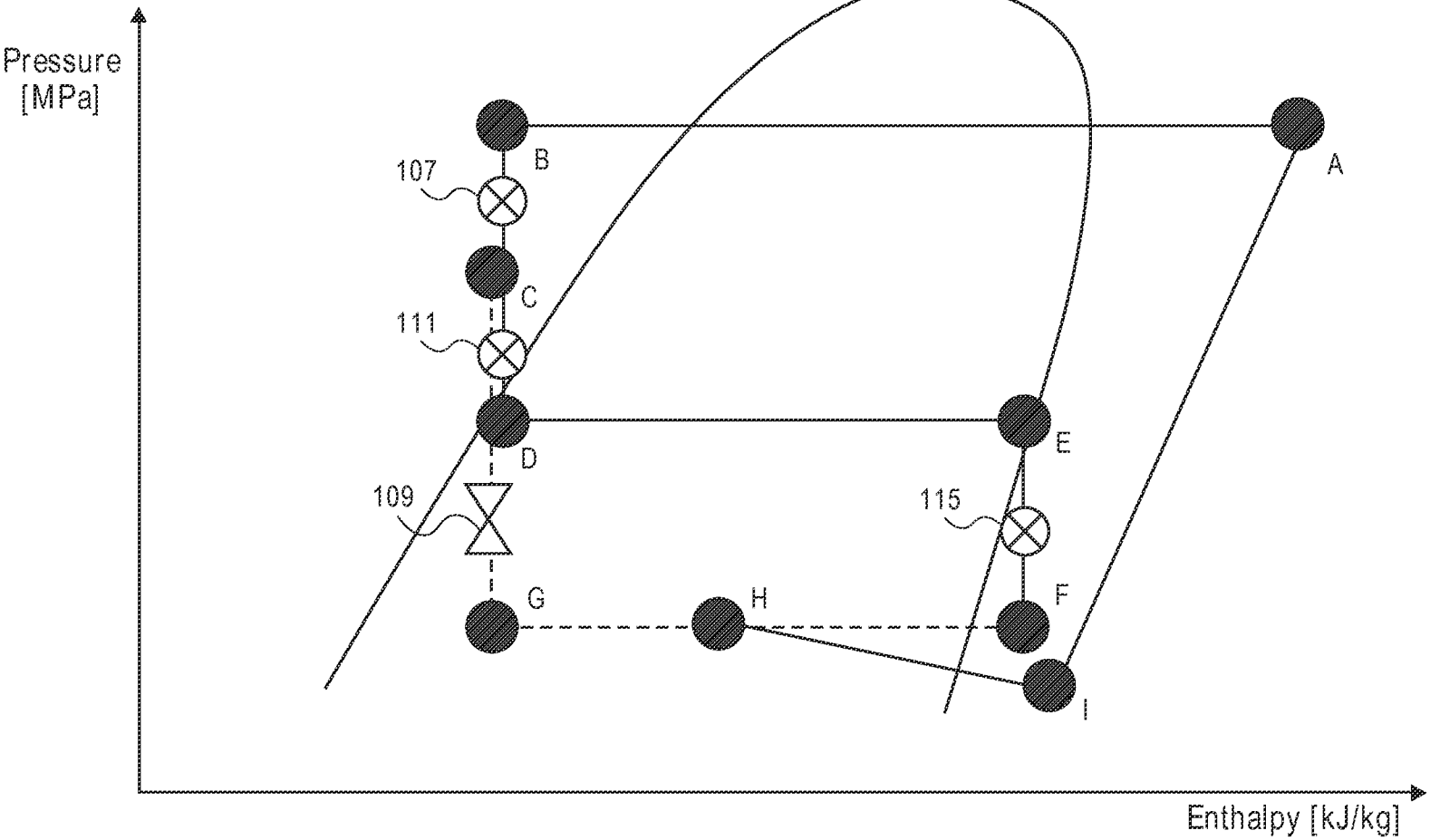
FIG. 2 is a pressure/enthalpy diagram of the refrigerant in the air conditioning system of FIG. 1.

Since the system components are most dearly understood in terms of refrigerant flow, the operation of the air conditioning system 100 is now provided, with reference also to the pressure/enthalpy diagram of FIG. 2. Referring then to both FIG. 1 and FIG. 2, during normal system operation, refrigerant flowing through the air conditioning system 100, as identified generally by directional arrows 127, attains a high pressure and high temperature state A after the refrigerant is compressed by the compressor 101. The refrigerant in state A passes through the four-way valve 103 and flows into the first utilization side heat exchanger 105. The first utilization side heat exchanger 105 is designed in the current embodiment to operate as a heating unit. As the refrigerant thus passes through the first utilization side heat exchanger 105, it condenses into a liquid phase as it is cooled by heat exchange with ambient air surrounding the first utilization side heat exchanger 105. It should be noted that during normal system operation, a fan of the first utilization side heat exchanger 105 may operate and propel warm air from the first utilization side heat exchanger 105 into the ambient air.

As the refrigerant flows through the first utilization side heat exchanger 105 and exchanges heat with ambient air surrounding the first utilization side heat exchanger 105, its temperature is decreased and its pressure is decreased or not changed, as represented by state B in FIG. 2. The refrigerant in state B then flows through the first expansion valve 107. The expansion valve 107 reduces the pressure and the temperature of the refrigerant. That is to say, at state C the refrigerant is decreased in pressure and temperature relative to state B.

The second expansion valve 111 then further reduces the pressure of the refrigerant at state D. At state D, the refrigerant is decreased in pressure and temperature relative to state C. The refrigerant at state C then flows into the second utilization side heat exchanger 113.

The second utilization side heat exchanger 113 is designed in the present embodiment to operate as a cooling unit. Therefore, as the refrigerant flows through the second utilization side heat exchanger 113, the refrigerant evaporates as it is heated by heat exchange with ambient air surrounding the second utilization side heat exchanger 113. It should be noted that during normal system operation, the fan of the second utilization side heat exchanger 113 may operate and propel cool air from the second utilization side heat exchanger into the ambient air surrounding the second utilization side heat exchanger 113.

After flowing through the second utilization side heat exchanger 113, at state E the refrigerant is maintained at the same pressure as at state D but increases significantly in temperature. For example, if the refrigerant is R41OA, the pressure of the refrigerant is maintained to a predefined amount, for example 0.985 MPa. As the refrigerant flows through the pressure control device 115, the pressure of the refrigerant is decreased by the pressure control device 115 to attain a high temperature, low pressure state F.

The decrease in pressure of the refrigerant to state F caused by the pressure control device 115 may not be significant enough to reduce the temperature of the refrigerant entering the compressor 101 (after exiting the heat source side heat exchanger 117) to cause the temperature of the refrigerant to be within a discharge temperature tolerance of the compressor 101 as the refrigerant exits the compressor 101. For example, a scroll type compressor in such an air conditioning system may have a maximum discharge temperature tolerance of approximately 120'C. Therefore, the bypass valve 109 is provided in order to additionally reduce the temperature of refrigerant entering the heat source side heat exchanger 117 to thereby subsequently reduce the temperature of the compressed refrigerant flowing out of the compressor 101.

As can be seen in FIG. 2, as the bypass valve 109 is controlled to reduce the pressure of the liquid refrigerant flowing through it, the temperature of the refrigerant remains low. That is to say, after flowing through the bypass valve 109, the refrigerant transitions from a relatively high pressure, low temperature state C to a low pressure, low temperature state G. As indicated in FIG. 2, the pressure of the refrigerant after flowing through the pressure control device 115 at state F is equal to the pressure of the refrigerant after flowing through the bypass valve 109 at state G.

Although the pressure of the refrigerant at states F and G is substantially equal, the refrigerant differs at state F from the refrigerant at state G in both phase and temperature. Specifically, at state F the refrigerant is in a high temperature gaseous state, while at state G the refrigerant is in a low temperature liquid state. Thus when the refrigerant mixes at state H (a low pressure, lower temperature state), the refrigerant is a two-phase gas/liquid mix that is at a temperature lower than at the gaseous state F.

Once the refrigerant is in a two-phase state H, the refrigerant flows into the heat source side heat exchanger 117. The refrigerant evaporates as it is heated by heat exchange with outside ambient air surrounding the heat source side heat exchanger 117, which in this embodiment is configured to operate as a cooling unit. As indicated in FIG. 2, the refrigerant flowing through the heat source side heat exchanger 117 reaches a low pressure, relatively high temperature state I.

It should be noted that by reducing the temperature of the refrigerant flowing into the heat source side exchanger 117, the temperature of the refrigerant at state I is low enough to be within a temperature tolerance (that is, below a predetermined maximum allowable temperature) of the compressor 101 as the refrigerant transitions from a relatively high temperature, low suction pressure state I to a very high temperature, very high pressure state A after being compressed by the compressor 101. Thus, it should be clear that if both the pressure control device 115 and the bypass valve 109 were absent from the air conditioning system 100, the refrigerant would enter the heat source side heat exchanger 117 at state E, which would shift the line between state I and state A farther to the right (and up), resulting in a much higher temperature endpoint upon flowing from the compressor 101.

Additionally, if only the bypass valve 109 were removed from the air conditioning system 100 (and the pressure control device 115 remained), the refrigerant would enter the heat source side heat exchanger 117 at state F. Although better than the first scenario in terms of resultant pressure after the refrigerant flows from the compressor 101, the line between state I and state A would still be shifted farther to the right, resulting in a much higher temperature endpoint after flowing from the compressor 101. Under either scenario, the resulting discharge temperature from the compressor 101 may simply be too high for the compressor 101 to operate without fault.

Succinctly put, in the air conditioning system of FIG. 1, the bypass valve 109 is configured to provide a variable amount of liquid refrigerant flowing from the expansion valve 107 to the heat source side heat exchanger 117. The pressure control device 115 and the bypass valve 109 thus cooperate with each other to keep a temperature of the compressor 101 below a maximum allowable temperature predetermined for the compressor 101. As discussed above, this is advantageous.

A brief description of the controller 125 is now provided. The controller 125 may be a microcontroller that is a highly integrated circuit and contains a processor core (i.e., a CPU), a read only memory (ROM), and a small amount of random access memory (RAM). The ROM may take several forms, including either NOR or NAND non-volatile flash memory, non-flash EEPROM memory, or any type of programmable read-only memory as would be known in the art.

The controller 125 will also include input/out (110) ports, and timers. A program for the controller 125 may be written in the ROM, and the CPU in communication with the air conditioning system 100 executes the program to control operation of the air conditioning system 100 through the I/O ports. The controller 125 is thus able to communicate with components of the air conditioning system, and is configured to control any component with either a variable or on/off setting. For example, the controller 125 controls a degree of opening of the bypass valve 109 (not just the on-off state of the bypass valve), and therefore provide the variable amount of liquid refrigerant to the heat source side heater exchanger 117 that bypasses the second utilization side heat exchanger 113 though the bypass valve 109. The controller 125 additionally controls the pressure control device 115.

The particular disposal of a line in FIG. 1 between the controller 125 and the air conditioning system 100 is arbitrary and is intended only to show that controller 125 is generally in communication with the air conditioning system 100. Although the line is shown as extending only from the controller 125 to the bypass valve 109, this is a matter of illustrative convenience. The controller 125 may communicate with all the components of the system 100 depending upon the specific system configuration. It should be understood that the controller 125, and more particularly the CPU, is configured to execute program instructions that cause the components of the air conditioning system 100 (and the air conditioning systems of the additional embodiments presented in this disclosure) to operate as described herein. This is true as to the operation of components of each air conditioning system during normal system operation and during defrost system operation.

The temperature sensor 120 is used to measure or detect the temperature of the refrigerant that flows from the second utilization side exchanger 113. Temperature measurements taken by the temperature sensor 120 are used by the controller 125 to adjust the pressure control device 115, to appropriately adjust the flow of refrigerant through this component. Specifically, an opening degree of the pressure control device 115 will be adjusted to provide a variable amount of refrigerant flowing therethrough based on the refrigerant temperature detected by the temperature sensor 120.

The temperature sensor 121 is used to measure or detect an outdoor air temperature as the refrigerant flows through the heat source side exchanger 117. Temperature measurements taken by the temperature sensor 121 are used by the controller 125 to adjust the bypass valve 109, to appropriately adjust the flow of refrigerant through this component. Specifically, an opening degree of the bypass valve 109 will be adjusted to provide a variable amount of refrigerant flowing therethrough based on the air temperature detected by the temperature sensor 121. For example, the bypass valve 109 is opened when the air temperature detected by the temperature sensor 121 is lower than a predetermined value.

The temperature sensor 123 measures the temperature of the refrigerant discharged through the compressor 101 that is correlated with the temperature of the compressor 101. The temperature measurements taken by the temperature sensor 123 are used by the controller 125 to adjust the bypass valve 109 to appropriately adjust the flow of refrigerant through this component.

As mentioned above, the temperature sensors 120, 121, 123 can be replaced by, or supplemented with, pressure sensors that detect pressure of the refrigerant discharged from the pressure control device 115, the heat source side heat exchanger 117 or the compressor 100 as discussed above. The measurements of such pressure sensors would be used by the controller 125 in determining adjustments to the bypass valve 109, the pressure control device 115 and/or the compressor 101 in a manner similar to that discussed above.

Figure 3:
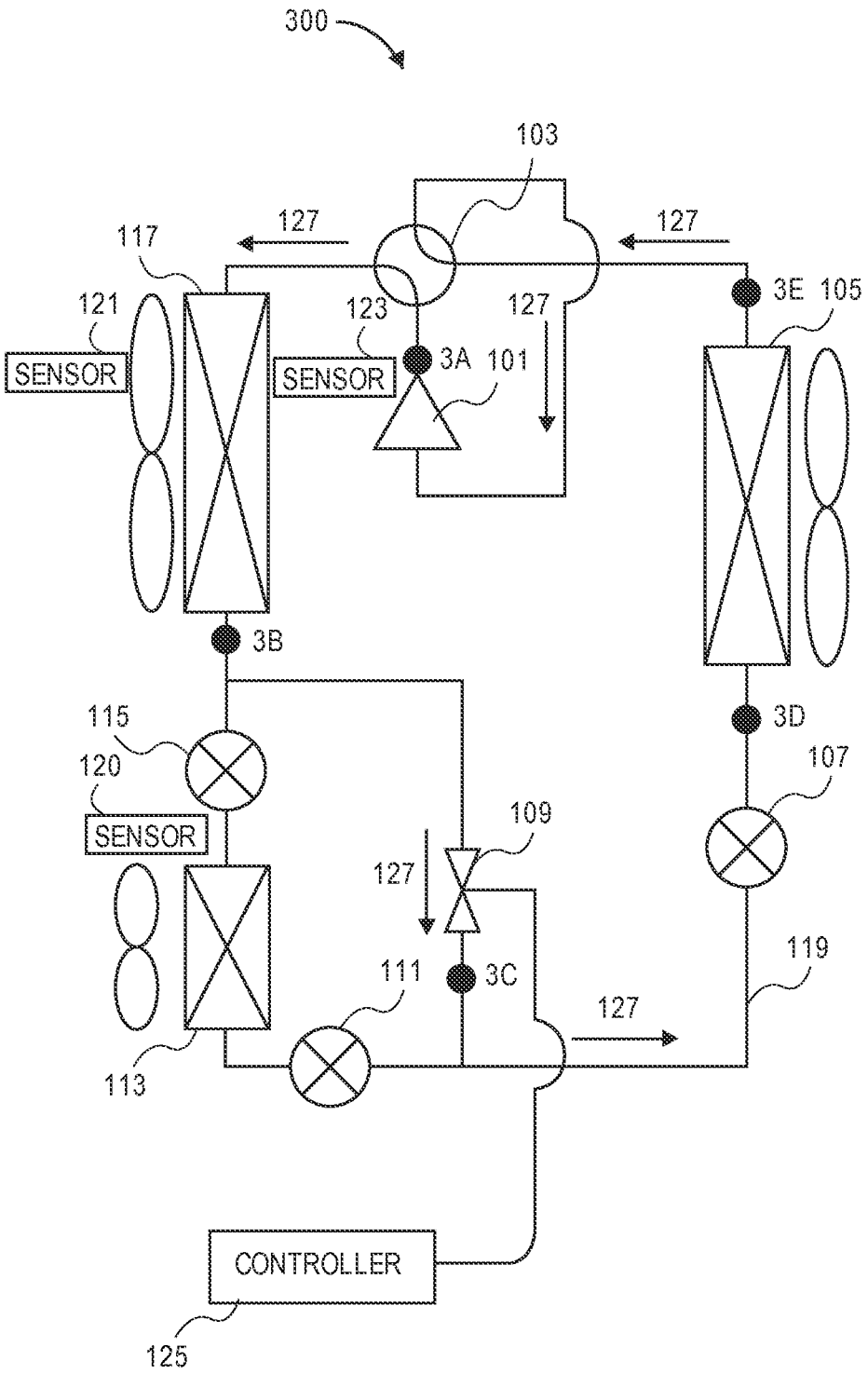
FIG. 3 is a diagram illustrating the air conditioning system of FIG. 1 during a defrost system operation.

As described above, after the air conditioning system 100 operates in normal system operation for a certain amount of time, frost tends to develop on the heat source side heat exchanger due to the cooling of the refrigerant as it absorbs heat from the ambient air. Therefore, as shown in FIG. 3, the air conditioning system 100 is also configured to run a system defrost operation. Specifically, the controller operates to switch the four-way valve 103 so that refrigerant flows in a direction opposite to the direction that the refrigerant flows during normal system operation as shown in FIG. 1.

It should be clear that the four-way valve 103, which is disposed between the first utilization side heat exchanger 105 and the heat source side heat exchanger 117, can be selectively switched as between the normal system operation and the system defrost operation. More specifically, during the normal system operation, the four-way valve 103 connect an outlet of the compressor 101 and the first utilization side heat exchanger 105 and an inlet of the compressor 101 and the heat source side heat exchanger 117. During the defrost system operation, the four-way valve 103 connect the outlet of the compressor 101 and the heat source side heat exchanger 117 and the inlet of the compressor 101 and the first utilization side heat exchanger 105.

Figure 4:
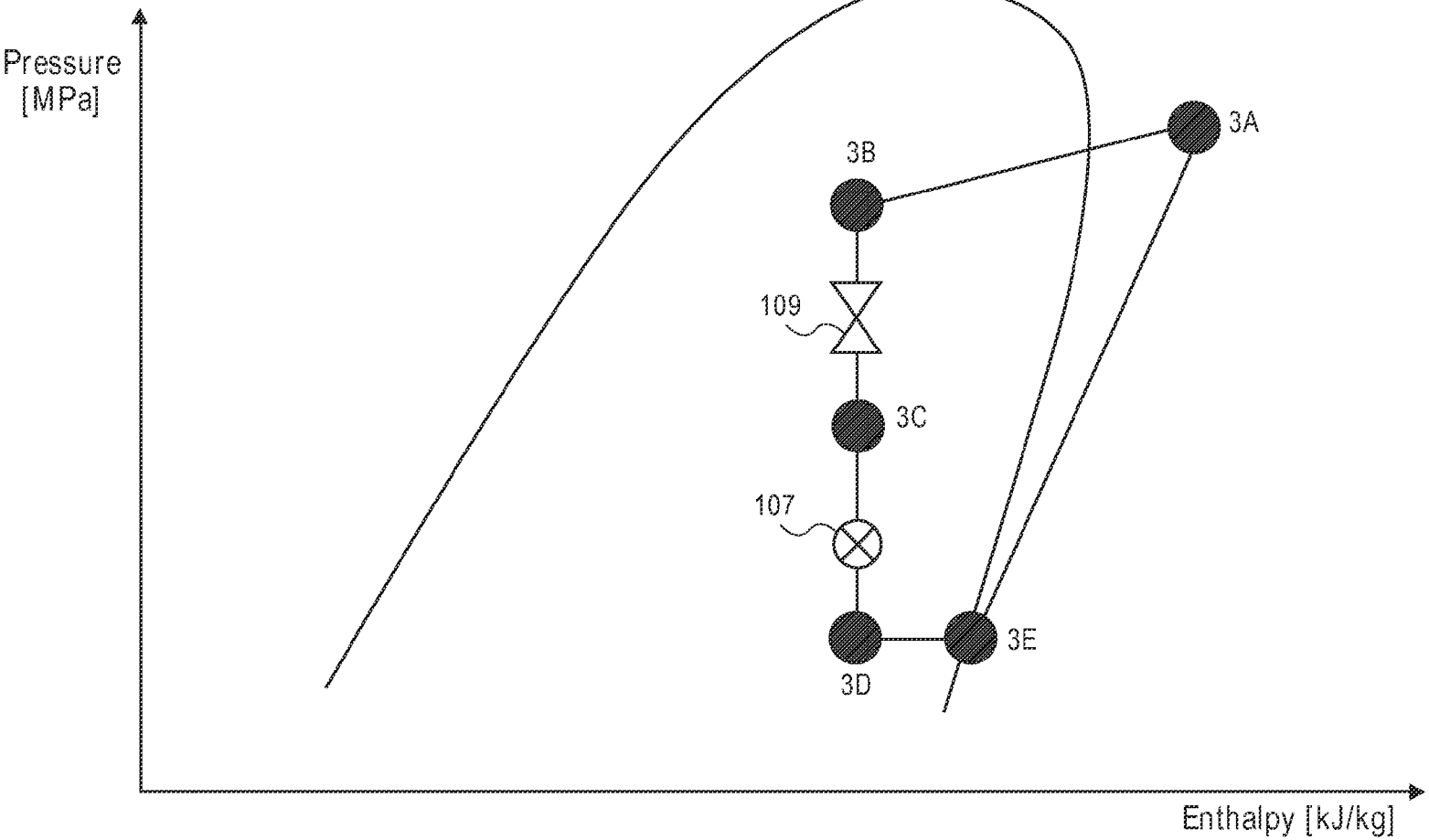
FIG. 4 is a pressure/enthalpy diagram of the refrigerant in the air conditioning system of FIG. 3.

As indicated above, the controller 125 operates to open the valve 109 when the degree of opening of the pressure control device 115 is very small during start-up of the defrost system operation. At start-up of the system defrost operation, pressure at the pressure control device 115 is quite low. FIG. 4, which is a pressure/enthalpy diagram, is now discussed to present a general view of refrigerant flowing in the air conditioning system 100 during defrost system operation.

The refrigerant enters a high temperature high pressure state 3A after it is compressed by the compressor 101. In FIG. 3, the four-way valve 103 is adjusted so that the outlet of the compressor 101 is connected with the inlet of the heat source side heat exchanger 117. The refrigerant in state 3A thus flows through the four-way valve 103 and into the heat source side heat exchanger 117.

As the refrigerant flows through the heat source side heat exchanger 117, the refrigerant is cooled by heat exchange with ambient air surrounding the heat source side heat exchanger 117 and melts frost on the heat source side heat exchanger 117. Therefore, the refrigerant enters a low temperature, slightly lower pressure state 3B.

As mentioned above, during the defrost system operation the bypass valve 109 is opened since pressure at the outlet of the second utilization side heat exchanger 113 is quite low. The controller 125 controls the bypass valve 109 so that the refrigerant in state 3B flows through the bypass valve 109 and decreases in pressure while decreasing its temperature and phase as it enters state 3C. At this point, there is little or no refrigerant passing through the pressure control device 115 and the second utilization side heat exchanger 113. Succinctly put, during the defrost system operation, the refrigerant exiting the heat source side heat exchanger 117 in state 313 flows through the bypass valve 109 attaining state 3C and enters the first expansion valve 107, therefore bypassing entirely the second utilization side heat exchanger 113.

The pressure of the refrigerant is lowered even further when it flows into the first expansion valve 107, and achieves a very low pressure state 3D. In fact, the pressure and temperature are such that the refrigerant is again in a two-phase state at 3D. When the two-phase refrigerant enters the first utilization side heater exchanger 105, liquid refrigerant is evaporated as the temperature of the refrigerant is increased to state 3E. The low pressure state is maintained at 3E. Lastly, the gaseous state refrigerant enters the compressor 101, where once again the pressure and temperature are increased to state 3A and the refrigerant returns to a gas phase.

As mentioned above, the controller 125 is able to communicate with the components of the air conditioning system 100 to control any component with a variable setting. For example, the controller 125 (and more particularly the CPU) controls a varying amount of liquid refrigerant that bypasses the second utilization side heat exchanger 113 though the bypass valve 109 such that the refrigerant flows from the heat source side heat exchanger 117 to the first expansion valve 107. The particular disposal of a line in FIG. 3 between the controller 125 and the air conditioning system 100 is arbitrary and is merely intended to show that controller 125 is in communication with the air conditioning system 100. Although the line extends from the controller 125 to the piping between the first and second expansion valves 107, 111 this is a matter of illustrative convenience. The controller 125 in fact may communicate with all the components of the system 100.

As discussed above, the temperature sensor 120 is used to measure or detect the temperature of the refrigerant that flows from the second utilization side exchanger 113. The temperature sensor 121 is used to measure or detect an outdoor air temperature as the refrigerant flows through the heat source side exchanger 117. The temperature sensor 123 measures the temperature of the refrigerant discharged through the compressor 101. Temperature sensors may be additionally disposed at other locations as well (although not shown) so that the controller 125 can appropriately adjust the bypass valve 109 and the pressure control device 115. For example, in the defrost system operation, a temperature sensor would be appropriate at the first utilization side heat exchanger 105.

Figure 5:
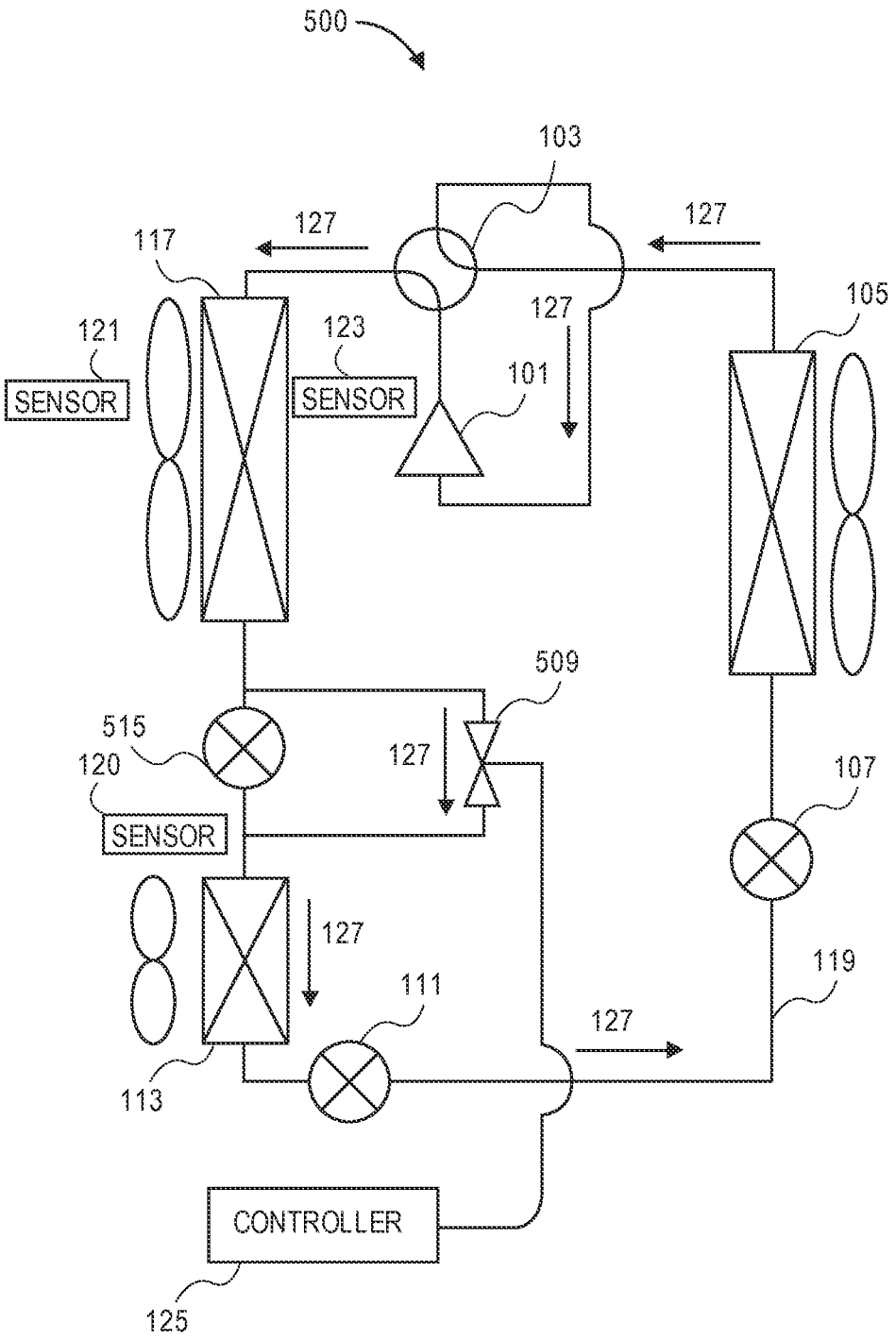
FIG. 5 is a diagram illustrating an air conditioning system with a pressure control device and bypass valve according to a second embodiment, during a defrost system operation.

FIG. 5 is a diagram illustrating an air conditioning system 500 with a pressure control device 515 and a bypass valve 509 according to a second embodiment, during a defrost system operation. Because many of the components in FIG. 5 correspond to like components in FIG. 1 and FIG. 3 and are identified by like reference numbers, further discussion of the operation of these components is omitted.

In the air conditioning system 500, the bypass valve is connected by piping, identified generally at 119, to both an inlet side and an outlet side of the pressure control device 515. The refrigerant enters a high temperature high pressure state after it is compressed by the compressor 101. The four-way valve 103 is adjusted so that the outlet of the compressor 101 is connected with the inlet of the heat source side heat exchanger 117. The refrigerant thus flows through the four-way valve 103 and through the heat source side heat exchanger 117. Consequently, the refrigerant is cooled by heat exchange with ambient air and melts frost on the heat source side heat exchanger 117. Therefore, the refrigerant enters a low temperature, slightly lower pressure state as it exits the heat source side heat exchanger 117.

As mentioned above, during the defrost system operation the bypass valve 509 is opened since pressure at the control device 515 is quite low. The controller 125 controls the bypass valve 509 so that the refrigerant flows from the heat source side heat exchanger 117 through the bypass valve 509, and into the second utilization side heat exchanger 113. At this point, there is little or no refrigerant passing through the pressure control device 515.

However, unlike in the air conditioning system 100 shown in FIG. 3, the lower pressure refrigerant does flow through the second utilization side heat exchanger 113. As a result, the temperature of the refrigerant is further increased, compared to the refrigerant that completely bypasses the second utilization side heat exchanger 113 and the second expansion valve 111 during the system defrost operation in FIG. 3. The bypass valve 509 in the air conditioning system 500 according to the second embodiment enables the heat source side heat exchanger 117 to be more quickly and efficiently defrosted during the defrost system operation.

Figure 6:
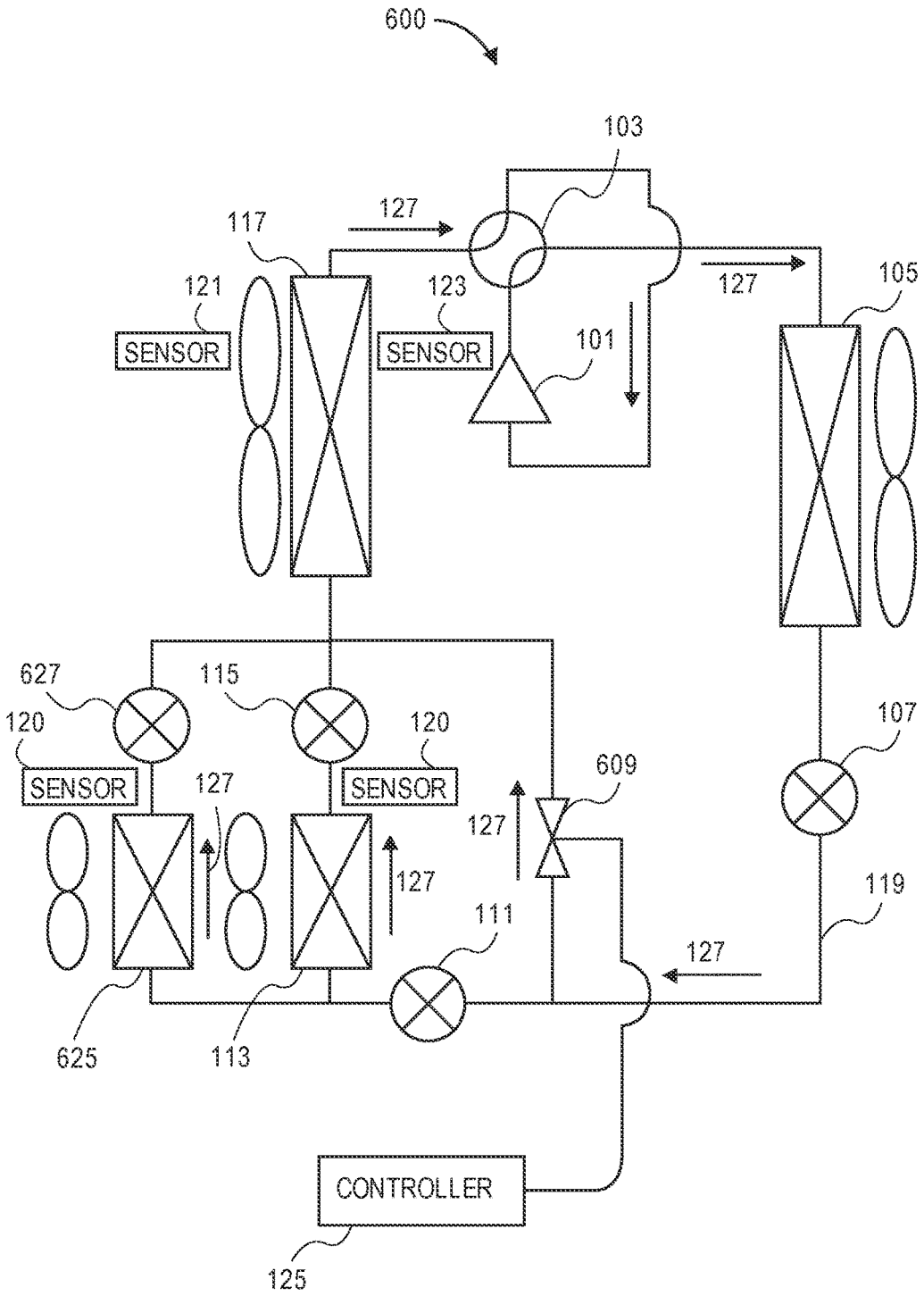
FIG. 6 is a diagram illustrating an air conditioning system with a plurality of pressure control devices and a bypass valve according to a third embodiment, during normal system operation.

FIG. 6 is a diagram illustrating an air conditioning system 600 according to a third embodiment during normal system operation. The air conditioning system 600 includes a third utilization side heat exchanger 625 in addition to the second utilization side heat exchanger 113, a second pressure control device 627 in addition to the first pressure control device 115, and a bypass valve 609. Because many of the components in FIG. 6 correspond to like components in FIG. 1, FIG. 3 and FIG. 5 and are identified by like reference numbers, further discussion of the operation of these components is omitted. In addition, although the air conditioning system 600 in FIG. 6 includes two utilization side heat exchangers in parallel, the system may alternatively include three or more utilization side heat exchangers with corresponding pressure control devices.

In the third embodiment, the third utilization side heat exchanger 625 is connected in parallel with the second utilization side heat exchanger 113. The second, or additional, pressure control device 627 is connected between the third utilization side heat exchanger 625 and the heat source side heat exchanger 117. As with the first pressure control device 115, the second pressure control device 627 is configured to maintain additional gaseous refrigerant that flows from the third utilization side heat exchanger 625 to the heat source side heat exchanger 117 at a further predefined pressure. The variable amount of liquid refrigerant flowing from the first expansion valve 107 to the heat source side heat exchanger 117 through the bypass valve 609 includes additional liquid refrigerant that bypasses the third utilization side heat exchanger 625 and the second pressure control device 627 to mix with the additional gaseous refrigerant maintained by the second pressure control device 627 at the further predefined pressure to form the two-phase refrigerant in a manner similar to the air conditioning system 100.

As a result, as in the air conditioning system 100, the bypass valve 109 is controlled to reduce the pressure of the liquid refrigerant flowing through it, and the temperature of the refrigerant remains low. That is to say, after flowing through the bypass valve 109, the refrigerant transitions from a relatively high pressure, low temperature state to a low pressure, low temperature state and forms a two-phase refrigerant prior to flowing into the heat source side heat exchanger 117 to thereby maintain the refrigerant at a temperature below the fault tolerance of the compressor 101. Succinctly put, the second pressure control device 627 is additionally configured in cooperation with the pressure control device 105 and the bypass valve 109 to keep the temperature of the compressor 101 below the maximum allowable temperature predetermined for the compressor.

In view of the above, one skilled in the art will appreciate that the embodiments described herein include a bypass valve in combination with a pressure control device in a refrigeration circuit. The pressure control device controls pressure of gaseous refrigerant flowing from a utilization side heat exchanger. The bypass valve is opened such that liquid refrigerant bypasses the utilization side heat exchanger. In this way, the bypass valve controls the state of the refrigerant that flows from the heat source side heat exchanger and thus the temperature of the refrigerant flowing into the compressor.

More specifically, the liquid refrigerant bypasses the utilization side heat exchanger and mixes with the gaseous refrigerant flowing from utilization side heat exchanger. A two-phase refrigerant is formed that is lower in temperature than the gaseous refrigerant that flows into the heat source side heat exchanger. The two-phase refrigerant flows into the heat source side heat exchanger at a temperature that is lower than the gaseous refrigerant that would otherwise only flow into the heat source side heat exchanger. As such, the discharge temperature of refrigerant exiting the compressor will not exceed the predetermined maximum allowable temperature of the compressor.

The bypass valve disclosed herein also aids in a defrost system operation of an air conditioning system. More specifically, when the defrost operation first begins, pressure at the inlet of the pressure control valve is below a predefined level due to the decreased pressure of the refrigerant at the inlet of the compressor, and the valve is substantially closed. As a result, refrigerant cannot flow through the heat source side heat exchanger. In the above described embodiments, in a defrost system operation refrigerant can bypass the pressure control valve through the bypass valve, and can then flow efficiently throughout the refrigerant circuit. As a result, the air conditioning system can efficiently complete the defrost system operation, and can at the same time protect the pressure control valve from damage that might otherwise occur if refrigerant were forced through the device.

This disclosure is intended to explain how to fashion and use various embodiments in accordance with the invention rather than to limit the true, intended, and fair scope and spirit thereof. The invention is defined solely by the appended claims, as they may be amended during the pendency of this application for patent, and all equivalents thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. An air conditioning system, comprising:

first and second utilization side heat exchangers and a heat source side heat exchanger respectively connected in series;

a compressor connected between the first utilization side heat exchanger and the heat source side heat exchanger;

an expansion valve connected between the first utilization side heat exchanger and the second utilization side heat exchanger, the expansion valve comprising first and second expansion valves connected in series;

a bypass valve connecting piping at an outlet of the heat source side heat exchanger with piping between the first expansion valve and the second expansion valve during a defrost system operation; and a pressure control device connected between the second utilization side heat exchanger and the heat source side heat exchanger; and, wherein the pressure control device is configured to maintain refrigerant that flows from the second utilization side heat exchanger to the heat source side heat exchanger at a predefined pressure, the bypass valve is configured to make refrigerant from the expansion valve bypass the second utilization side heat exchanger and the pressure control device, and the pressure control device and the bypass valve are configured in cooperation with each other to keep a temperature of the compressor below a maximum allowable temperature predetermined for the compressor.

2. The air conditioning system according to claim 1, further comprising:

a temperature sensing device configured to detect an outdoor air temperature, wherein the bypass valve is further configured to be opened when the air temperature detected by the temperature sensing device is lower than a predetermined value.

3. The air conditioning system according to claim 1, further comprising:

a temperature sensing device configured to detect an outdoor air temperature, wherein the bypass valve is further configured to provide a variable amount of refrigerant flowing therethrough, and be controlled in opening degree thereof, based on the air temperature detected by the temperature sensing device.

4. The air conditioning system according to claim 1, further comprising:

a temperature sensing device configured to detect a temperature of the refrigerant discharged from the compressor that is correlated with the temperature of the compressor, wherein the bypass valve is further configured to be controlled based on the temperature of the refrigerant detected by the temperature sensing device.

5. The air conditioning system according to claim 1, further comprising:

a pressure sensing device configured to detect a pressure of the refrigerant discharged from the compressor that is correlated with the temperature of the compressor, wherein the bypass valve is further configured to provide a variable amount of refrigerant flowing therethrough, and to be controlled in an opening degree thereof, based on the pressure of the refrigerant detected by the pressure sensing device.

6. The air conditioning system according to claim 1, further comprising:

a controller including a central processing unit (CPU) that is configured to control the air conditioning system under normal system operation during which the refrigerant flows from the heat source side heat exchanger through the compressor to the first utilization side heat exchanger, and to control the air conditioning system under defrost system operation during which the refrigerant flows in reverse.

7. The air conditioning system according to claim 6, further comprising:

a four-way valve that can be selectively switched between the normal system operation and the defrost system operation, wherein during the normal system operation, the four-way valve is configured to connect an outlet of the compressor and the first utilization side heat exchanger and an inlet of the compressor and the heat source side heat exchanger, and during the defrost system operation, the four-way valve is configured to connect the outlet of the compressor and the heat source side heat exchanger and the inlet of the compressor and the first utilization side heat exchanger.

8. The air conditioning system according to claim 1, wherein, during normal system operation, the first utilization side heat exchanger is configured to operate as a heating unit, the second utilization side heat exchanger is configured to operate as a cooling unit, and the heat source side heat exchanger is configured to operate as a cooling unit.

9. An air conditioning system, comprising:

first and second utilization side heat exchangers and a heat source side heat exchanger respectively connected in series;

a compressor connected between the first utilization side heat exchanger and the heat source side heat exchanger;

an expansion valve connected between the first utilization side heat exchanger and the second utilization side heat exchanger, the expansion valve comprising first and second expansion valves connected in series;

a bypass valve connecting piping at an outlet of the heat source side heat exchanger with piping between the first expansion valve and the second expansion valve during a defrost system operation; and a pressure control device connected between the second utilization side heat exchanger and the heat source side heat exchanger wherein the pressure control device is configured to maintain refrigerant that flows from the second utilization side heat exchanger to the heat source side heat exchanger at a predefined pressure, and the bypass valve is configured to provide a variable amount of liquid refrigerant flowing from the expansion valve to the heat source side heat exchanger.

10. The air conditioning system according to claim 9, wherein during a defrost system operation, the bypass valve is configured to provide refrigerant flowing from the heat source side heat exchanger to the expansion valve.

11. The air conditioning system according to claim 9, further comprising:

a controller including a central processing unit (CPU) that is in communication with the air conditioning system, wherein the controller is configured to control the bypass valve to provide the variable amount of refrigerant to the heat source side heat exchanger.

12. The air conditioning system according to claim 10, further comprising:

a controller including a central processing unit (CPU) that is in communication with the air conditioning system, wherein the controller is configured to control the bypass valve to provide the refrigerant that flows from the heat source side heat exchanger to the expansion valve.

13. A controller including a central processing unit (CPU) that is in communication with an air conditioning system, the air conditioning system including:

first and second utilization side heat exchangers and a heat source side heat exchanger, respectively connected in series;

a compressor connected between the first utilization side heat exchanger and the heat source side heat exchanger;

an expansion valve connected between the first utilization side heat exchanger and the second utilization side heat exchanger, the expansion valve comprising first and second expansion valves connected in series;

a bypass valve connecting piping at an outlet of the heat source side heat exchanger with piping between the first expansion valve and the second expansion valve during a defrost system operation; and a pressure control device connected between the second utilization side heat exchanger and the heat source side heat exchanger, and the CPU being configured to execute instructions to cause, during normal system operation:

the pressure control device to maintain refrigerant that flows from the second utilization side heat exchanger to the heat source side heat exchanger at a predefined pressure;

the bypass valve to make refrigerant from the expansion valve bypass the second utilization side heat exchanger and the pressure control device, and the pressure control device and the bypass valve cooperate with each other to keep a temperature of the compressor below a maximum allowable temperature predetermined for the compressor.

14. The controller according to claim 13, wherein the CPU is further configured to execute instructions to cause, during a defrost system operation, the bypass valve to provide refrigerant flowing from the heat source side heat exchanger to the expansion valve, therefore bypassing the second utilization side heat exchanger.

15. The controller according to claim 13, wherein in the air conditioning system, during normal system operation, the first utilization side heat exchanger is configured to operate as a heating unit, the second utilization side heat exchanger is configured to operate as a cooling unit, and the heat source side heat exchanger is configured to operate as a cooling unit.

16. The controller according to claim 14, wherein in the air conditioning system, the expansion valve comprises first and second expansion valves connected in series, and the bypass valve connects piping at an outlet of the source side heater exchanger with piping between the first expansion valve and the second expansion valve.

17. The controller according to claim 14, wherein the air conditioning system further includes a four-way valve that can be selectively switched between the normal system operation and the defrost system operation, during the normal system operation, the four-way valve is configured to connect an outlet of the compressor and the first utilization side heat exchanger and an inlet of the compressor and the heat source side heat exchanger, and during the defrost system operation, the four-way valve is configured to connect the outlet of the compressor and the heat source side heat exchanger and the inlet of the compressor and the first utilization side heat exchanger.

* * * * *